US006701542B2

(12) United States Patent
Marbach

(10) Patent No.: US 6,701,542 B2
(45) Date of Patent: Mar. 9, 2004

(54) FLOATING WEIR SKIMMER FOR A FLEXIBLE-WALLED ABOVE-GROUND POOL

(75) Inventor: Gerard Marbach, Cernay (FR)

(73) Assignee: Sevylor International (FR)

( * ) Notice: Subject to any disclaimer, the term of this patent is extended or adjusted under 35 U.S.C. 154(b) by 0 days.

(21) Appl. No.: 10/155,426

(22) Filed: May 24, 2002

(65) Prior Publication Data

US 2002/0178494 A1 Dec. 5, 2002

(30) Foreign Application Priority Data

May 25, 2001 (FR) ..... 01 06886

(51) Int. Cl.[7] ..... E04H 4/10; E04H 7/00

(52) U.S. Cl. ..... 4/507; 4/508; 4/490; 4/512; 210/416.2

(58) Field of Search ..... 4/507, 508, 496, 4/490, 506, 512; 52/169.7; 210/169, 416.2, 232, 473, 474, 776

(56) References Cited

U.S. PATENT DOCUMENTS 4,426,286 A 1/1984 Puckett et al. ..... 210/121
5,181,283 A * 1/1993 Gillebaard ..... 4/496
5,672,271 A * 9/1997 Dye ..... 210/169

FOREIGN PATENT DOCUMENTS

DE 2364468 7/1975

* cited by examiner

*Primary Examiner*—Henry Bennett
*Assistant Examiner*—Amanda Flynn
(74) *Attorney, Agent, or Firm*—Dean W. Russell; Kilpatrick Stockton LLP

(57) ABSTRACT

A floating weir skimmer (1) with a pivoting flap (2) that can be fixed to a flexible wall (3) of an above-ground pool, comprising: a flexible pouch (4) with an open front face (7) that can be sealed to the exterior face of the flexible wall (3) to correspond with an opening (8) therein, and a removable rigid cassette (9) in the flexible pouch (4), with two side walls (10) frontally defining a water inlet (11) facing the opening (8) and at the bottom a water outlet (12), this cassette containing a pivoting floating flap (2) with its axle (13) fixed to the base of the side walls (10) near the inlet (11).

13 Claims, 2 Drawing Sheets

FLOATING WEIR SKIMMER FOR A FLEXIBLE-WALLED ABOVE-GROUND POOL

This application claims priority to French Patent Application No. 01 06886 filed on May 25, 2001, the entire contents of which are incorporated by reference herein.

FIELD OF THE INVENTION

The present invention relates to improvements made to floating weir skimmers able to be fixed to a flexible wall of an above-ground pool.

In the description that follows, a "flexible wall" is to be understood as denoting both an actual side wall of a flexible-walled pool either of the self-supporting type or of the type supported by a framework, and the sealed liner arranged in a pool with rigid peripheral walls.

DESCRIPTION OF THE PRIOR ART

Document U.S. Pat. No. 5,181,283 discloses a flexible skimmer of the aforementioned kind which consists of a flexible pouch containing a holed basket functionally associated with a water outlet and to the top of which a pivoting floating flap situated facing a water inlet opening at the level of the surface of the water in the pool is fixed. Such a skimmer being secured to the flexible side wall, supported by a framework, of an above-ground pool.

The major disadvantage with this known arrangement lies in the fact that the pivoting floating flap cannot fulfil its role correctly. If the flap is correctly sized so that it leaves only a minimum clearance between it and the side walls of the skimmer, then these walls, which are flexible and which therefore do not have a perfectly defined profile, deform and come into contact with the flap, jamming it and preventing it from performing its role. If, on the other hand, the flap is sized to make sure that the flexible walls when deformed will not impede the flap, then the clearance between the flexible walls and the ends of the flap becomes too great: water then flows freely through these lateral gaps instead of running over the flap in the form of a thin layer of water; the skimmer function is then no longer fulfilled.

In short, the flexible skimmer described in that document is not, because of its design, able to operate correctly.

However, the use of a flexible skimmer is advantageous per se because the flexible pouch of such a skimmer which is sealed securely to the flexible wall of the above-ground pool does not constitute an impediment when the pool is dismantled and folded up for sale and for storage when it is not in use.

In addition, a flexible skimmer structure is, in practice, a simple and reliable solution for forming an external skimmer for an above-ground pool because fixing it to the flexible wall by bonding or by welding provides an effective seal without the need for additional means (gaskets, flanges, nuts and bolts).

SUMMARY OF THE INVENTION

It is essentially an objective of the invention to propose an improved technical solution to the forming of a floating weir skimmer which operates reliably and effectively and can be mounted on the outside of flexible-walled above-ground pools.

To these ends, a floating weir skimmer with a pivoting flap able to be fixed to a flexible wall of an above-ground pool, is characterized, while being arranged in accordance with the invention, in that it comprises, in combination:

- a flexible pouch having an open front face that can be sealed to the exterior face of the flexible wall of the pool to correspond with an opening made in the flexible wall of the pool, and
- a rigid cassette arranged removably in the flexible pouch and having two side walls frontally defining a water inlet opening able to face the opening made in the flexible wall of the pool and, at the bottom, a water outlet opening, the said cassette containing a pivoting floating flap with its axle fixed to the base of the side walls near the said inlet opening.

By virtue of this arrangement, there is formed an improved skimmer which combines the advantages of rigid skimmers with those of flexible skimmers.

The skimmer of the invention maintains the advantage inherent in flexible skimmers, namely the casing constructed in the form of a flexible pocket which can be sealed securely (by bonding or welding) to the flexible wall of the pool: the assembly maintains its ability to be able to be folded up easily (for sale or storage).

By contrast, the technical operation of the skimmer, which is dependent upon the correct operation of the pivoting floating flap, is here assigned to a distinct element, of rigid structure, but of small bulk, and which can therefore easily be stored outside the flexible pouch when the pool is folded up. It is recourse to this rigid structure which gives the possibility of correct operation of the flap: what happens is that the presence of the two rigid side walls allows the flap to be sized in such a way that just two very small gaps, too small to allow a significant amount of water to flow through them, are left between its ends and the said rigid walls. What is more, at least the upper edge of the side walls supports the flexible pouch and prevents it from collapsing: there is therefore no risk of the flap being impeded in its movement by the collapsed pouch. Definitively speaking, the flap, free to move, can occupy the required position with its upper edge situated immediately below the surface of the water and the water can flow out in no way other than by allowing a thin film of liquid to spill over the upper edge of the flap, in accordance with the conditions of correct operation.

In a preferred embodiment, the rigid cassette has an open bottom defining the aforementioned water outlet opening, and means of supporting a removable strainer are associated with the said bottom, this strainer being intended to collect the debris carried by the flow of liquid. However, it is also possible to provide a solid additional plate equipped with a flitting for connecting a flexible tube of a suction brush device, which additional plate is fitted from above.

In a more complete embodiment which, in practice, is preferred, the flexible pouch comprises a lower part able to extend below the aforementioned opening made in the flexible wall of the pool and housing a second removable rigid cassette or lower cassette underlying the first aforementioned removable rigid cassette or upper cassette. In this case, it is advantageous that the bottom of the lower part of the flexible pouch and the bottom of the lower rigid cassette comprise respective holes corresponding with one another and able to take a water outlet fitting that can be connected to a hose.

Advantageously, the flexible pouch is made of a synthetic material which is compatible, for bonding or welding, with the material of which the flexible wall of the pool is made; in particular, as the flexible wall of above-ground pools is often made of PVC, it is desirable for the flexible pouch too to be made of PVC.

Advantageously, to make it easier for the flexible pouch to be sealed securely and reliably to the flexible wall of the pool, provision is made for the open front face of the flexible pouch to be bordered around its periphery with a widened rim able to allow it to be sealed securely and reliably by welding or bonding to the flexible wall of the pool.

In a robust embodiment, the upper cassette is equipped with a rear and top wall of curved shape roughly in the form of a sector of a cylinder with symmetry of revolution centred approximately on the axis of rotation of the flap so that the cassette has good rigidity and great robustness, with its side walls appropriately braced apart so as not to impede the movement of the flap; the flexible pouch is shaped accordingly in its upper part.

BRIEF DESCRIPTION OF THE DRAWINGS

The invention will be better understood from reading the detailed description which follows of one preferred embodiment which is given solely by way of non-limiting example. In this description, reference is made to the appended drawings in which.

DETAILED DESCRIPTION OF THE INVENTION

Figure 1:
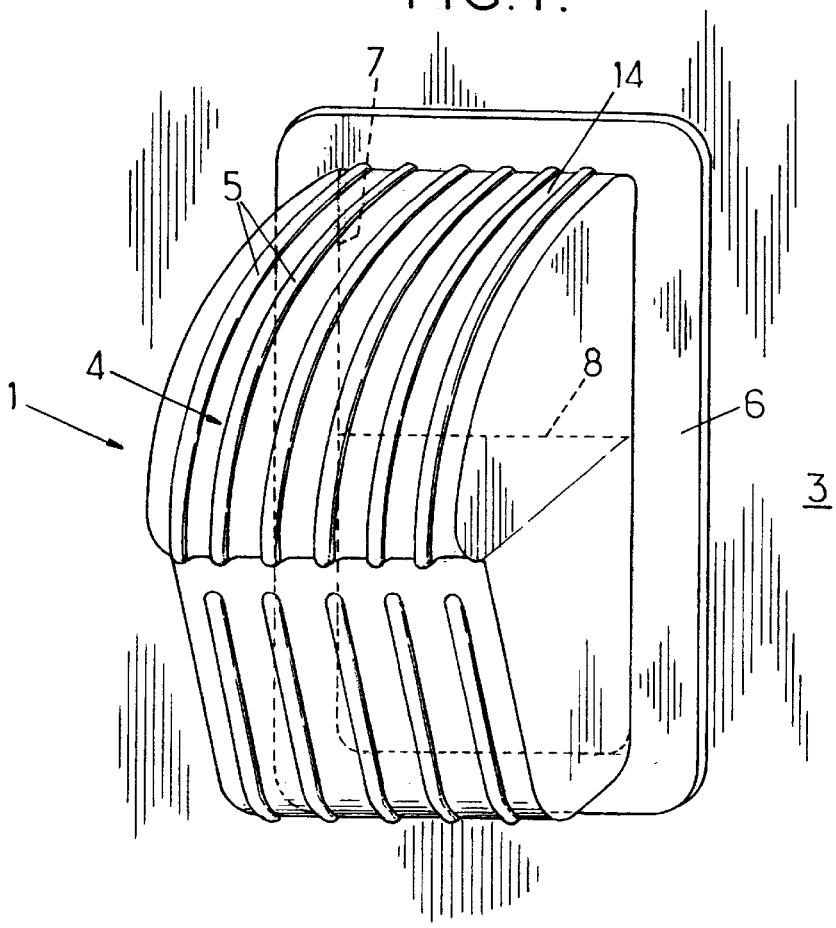
FIG. 1 is an external perspective view of a skimmer according to the invention, fixed to a flexible wall of an above-ground pool.
Figure 2:
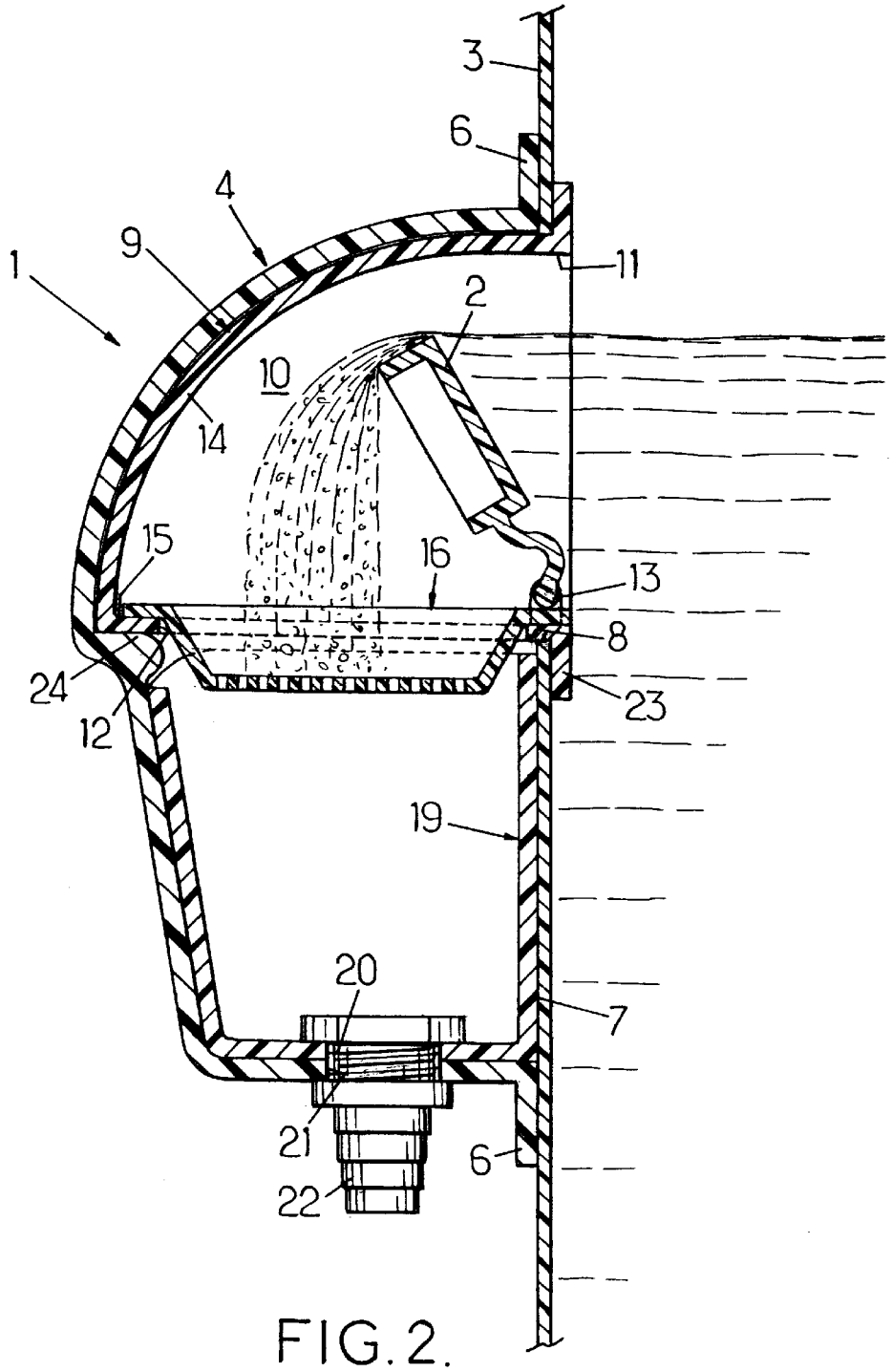
FIG. 2 is a view in cross section from the side of the entirety of the skimmer of FIG. 1.

Referring first of all to FIGS. 1 and 2, these depict a floating weir skimmer 1 with a pivoting flap 2 able to be fixed to the exterior face of a flexible wall 3 of an above-ground pool, for example the peripheral wall of a pool of the self-supporting type.

The skimmer 1 comprises a flexible pouch 4 made of flexible material compatible, with a view to assembly by bonding or welding, with the material of which the flexible wall 3 of the above-ground pool is made. As the flexible walls 3 of above-ground pools are often made of PVC, the flexible pouch 4 may advantageously be made of PVC, and it may have stiffening ribs 5 in certain parts and/or surfaces.

To make it easier to fix to the flexible wall 3 of the pool, the flexible pouch 4 may have a widened peripheral rim 6. The relatively large assembly area (for bonding, welding) makes it easier to seal securely and reliably to the flexible wall 3.

The flexible pouch 4 has a front face (in other words the face for assembly with the flexible wall of the pool) which is open at 7 and which corresponds with an opening 8 made in the flexible wall 3 of the pool. In the particular embodiment of the skimmer which is illustrated in FIGS. 1 and 2, it is the upper part of the opening 7 which correspond with the opening 8 in the flexible wall 3 of the pool whereas, as will become apparent later on, the lower part of the opening 7 is closed off by that part of the flexible wall 3 which underlies the opening 8.

Figure 3:
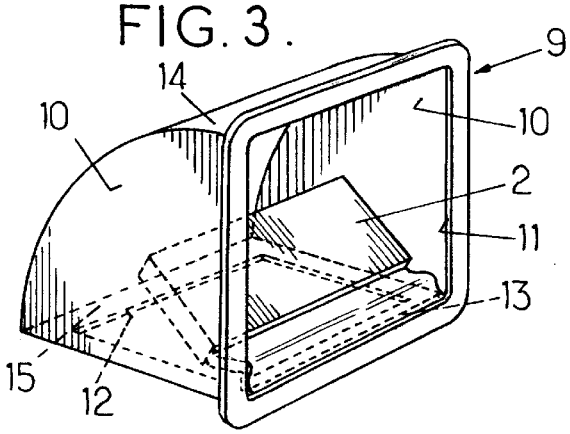
FIG. 3 is a perspective view of a rigid cassette with a floating pivoting flap incorporated into the skimmer of FIGS. 1 and 2.

Inside the flexible pouch 4 (that is to say inside the upper part of the flexible pouch 4 in the embodiment more specifically illustrated) there is a rigid cassette 9 arranged removably. As can be seen better in FIG. 3, this cassette 9, for example made of rigid moulded plastic, comprises two side walls 10 which frontally define a water inlet opening 11. This opening 11 is, as visible in FIG. 3, situated to correspond with the opening 8 made in the flexible wall 3 of the pool. The cassette 9 also has, at the bottom, another opening 12 for a water outlet.

The cassette 9 contains a pivoting floating flap 2 the rotation axle 13 of which is fixed to the anterior base of the side walls 10, near the lower edge of the said inlet opening 11. The buoyancy of the flap 2 may be conferred either by an appropriate choice of the material of which it is made, which has a density lower than 1 (in practice, the flap is moulded from a plastic the most common of which generally have a density lower than 1), or by adding suitable buoyancy means to it.

Arranging the flap 2 so that it is mounted to pivot between the two rigid walls 10 of the cassette 9 makes it possible for small gaps which are only just sufficient to allow the flap to rotate freely to be left between the ends of the flap and the walls 10 opposite.

To give the cassette appropriate rigidity and make sure that the walls 10 are held apart in a stable way, it is advantageous for the cassette 9 to comprise a rear and top wall 14 of curved shape roughly in the form of a sector of a cylinder with symmetry of revolution approximately centred on the rotation axle 13 of the flap. The flexible pouch 4 may then, in its upper part, be shaped accordingly, as visible in FIG. 1.

The cassette 9 has a widely open bottom 15 to define the aforementioned water outlet opening 12. Associated with this bottom 15 are means of supporting a removable plate. These support means may simply consist of the portion of the bottom 15 which forms a rim peripherally bordering the water outlet opening 12, as visible more clearly in FIG. 3.

In the usual way, the plate mentioned above is a strainer 16 which may in the form of a basket with a holed bottom as visible in FIG. 2 and which has a laterally protruding upper rim via which it rests on the bottom portion 15 peripherally bordering the opening 12 through which the strainer 16 is engaged. This basket collects the debris floating on the surface of the water.

Figure 4:
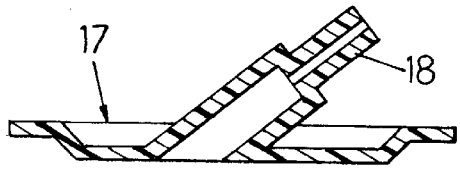
FIG. 4 is a schematic view in section of another accessory of the skimmer of FIGS. 1 and 2.

It is also possible to provide, as illustrated in FIG. 4, a solid additional plate 17 equipped with a tubular fitting 18 projecting upwards and constituting a tapping for the attachment of a flexible tube connected to a suction brush used for cleaning the pool. The plate 17 is designed to be able to be fitted above the strainer 16.

To make it easier for the device which has just been described to work while the water leaving the strainer 16 is removed by a suction device, it is desirable for the structure mentioned above to be supplemented by adding to it, between the strainer 16 and a water discharge orifice, a buffer chamber. This specific embodiment is illustrated more particularly in FIGS. 1 and 2.

To this end, the flexible pouch 4 is extended at the bottom by a lower part which extends below the opening 8 made in the flexible wall of the pool (the frontal opening 7 of the flexible pouch 4 is then, in this lower part, closed off by the flexible wall portion underlying the opening 8).

A second rigid cassette 19 is arranged removably inside this lower part of the flexible pouch 4. This second rigid cassette 19 or lower cassette has the general appearance of a tin open at the top under the strainer 16. Its bottom has a hole 20 situated facing a hole 21 made in the bottom of the flexible pouch 4 and a fitting 22 is fixed into the holes 20–21 for connecting the device to a hose for discharging the water to a suction inlet of a water filtration device.

In the complete embodiment depicted in FIG. 2, the upper cassette 9 is held in position by giving it, at least under the lower edge of its water inlet opening 11, a downwardly protruding rim 23 which sits over the edge of the opening 8 of the wall of the pool. On the opposite side, the flexible pouch 4 is arranged so that its internal wall has a protruding bead 24, for example situated approximately where the aforementioned upper and lower parts of the flexible pouch meet: the bottom 15 of the cassette 9 bears, at the rear, against this protruding bead 24.

The flexible pouch skimmer arrangement which has just been described finds a preferred application in equipping an above-ground pool with flexible side walls either of the self-supporting type or of the type supported by a framework. However, such an arrangement may also find an application in above-ground pools with rigid side walls equipped with a flexible internal liner: in this case, the flexible pouch of the skimmer is secured to the said flexible liner and protrudes externally through a cut-out made in the rigid side wall of the pool. In the latter case, the benefit of such an arrangement lies in the pre-mounting, at the factory, of the flexible pouch of the skimmer on the flexible liner, with a perfectly sealed bond, avoiding the difficulties that users encounter when mounting rigid skimmers using a screw-fastened assembly employing flanges and gaskets.

What is claimed is:

1. A floating weir skimmer with a pivoting flap able to be fixed to a flexible wall of an above-ground pool, said skimmer comprising:

a flexible pouch having an open front face that can be sealed to the exterior face of the flexible wall of the pool to correspond with an opening made in the flexible wall of the pool, wherein a rigid cassette is removably located in the flexible pouch, and wherein said rigid cassette has a bottom two side walls having a base and frontally defining a water inlet opening able to face the opening made in the flexible wall of the pool, a pivoting floating flap having an axle fixed to the base of the side walls near said inlet opening, and a water outlet opening located at the bottom thereof.

2. A skimmer according to claim 1, wherein the rigid cassette has an open bottom defining the aforementioned water outlet opening, and wherein means of supporting a removable strainer are associated with said bottom.

3. A skimmer according to claim 2, further comprising a solid removable plate which is equipped with a fitting for connecting a flexible tube of a suction brush device.

4. A skimmer according to claim 1, wherein the flexible pouch comprises a lower part which is able to extend below the aforementioned opening made in the flexible wall of the pool and which houses a second removable rigid cassette or lower cassette underlying the first aforementioned removable rigid cassette or upper cassette.

5. A skimmer according to claim 4, wherein the bottom of the lower part of the flexible pouch and the bottom of the lower rigid cassette comprise respective holes (i) corresponding with one another and (ii) able to take a water outlet fitting that can be connected to a hose.

6. A skimmer according to claim 4, wherein the upper cassette is equipped with a rear and top wall of curved shape roughly in the form of a sector of a cylinder with symmetry of revolution centered approximately on the axis of rotation of the flap, and wherein the flexible pouch is, in its upper part, shaped accordingly.

7. A skimmer according to claim 1, wherein the flexible pouch is made of a synthetic material which is compatible, for bonding or welding, with the material of which the flexible wall of the pool is made.

8. A skimmer according to claim 7, wherein the flexible pouch is made of PVC.

9. A skimmer according to claim 7, wherein the open front face of the flexible pouch is bordered around its periphery with a widened rim able to allow it to be sealed securely by welding or bonding to the flexible wall of the pool.

10. A skimmer according to claim 1, wherein at least the exterior face of the flexible pouch has protruding ribs.

11. A floating weir skimmer adapted for attachment to a flexible wall of an above-ground swimming pool having an opening therein and an exterior face, the skimmer comprising:

a. a flexible pouch having upper and lower portions, the upper portion having an open front face that, in use, is sealed to the exterior face of the flexible wall so as to correspond with the opening therein;

b. a first rigid cassette positioned in the upper portion of the flexible pouch, having a bottom, and comprising:

i. a plurality of side walls having a base and frontally defining a water inlet opening facing, in use, the opening in the flexible wall;

ii. a pivoting flap having an axle fixed to the base of the plurality of side walls so that at least a portion of the side walls extends above the pivoting flap; and iii. a water outlet opening located at the bottom.

12. A skimmer according to claim 11 further comprising a second rigid cassette positioned in the lower portion of the flexible pouch.

13. A skimmer according to claim 12 in which each of the first and second rigid cassettes is removable.

* * * * *